United States Patent [19]

McGee et al.

[11] Patent Number: 4,902,071

[45] Date of Patent: Feb. 20, 1990

[54] LIFT RECLINER-ROCKER

[76] Inventors: Danny C. McGee, Rt. 1, Box 9, Big Creek, Miss. 38914; Harold G. McMahan, P.O. Box 267, Calhoun City, Miss. 38916

[21] Appl. No.: 336,332

[22] Filed: Apr. 11, 1989

[51] Int. Cl.[4] ..... A47C 3/02

[52] U.S. Cl. ..... 297/270; 297/310

[58] Field of Search ..... 297/270, 310, 258

[56] References Cited

U.S. PATENT DOCUMENTS

| | | | |
|---|---|---|---|
| 1,985,131 | 12/1934 | Wilke | 297/260 |
| 2,772,723 | 12/1956 | Tunnell | 297/267 |
| 3,256,040 | 6/1966 | Mize et al. | 297/310 |
| 3,339,972 | 9/1967 | Fletcher | 297/259 |
| 3,371,959 | 3/1968 | Gordin | 297/270 X |
| 3,596,991 | 8/1971 | McKee | 297/326 |
| 4,007,960 | 2/1971 | Gaffney | 297/71 |
| 4,083,599 | 4/1978 | Gaffney | 297/131 |
| 4,123,102 | 10/1978 | Landry et al. | 297/270 |
| 4,227,740 | 10/1980 | East | 297/310 |
| 4,319,780 | 3/1982 | Rogers, Jr. | 297/85 |
| 4,453,766 | 6/1984 | DiVito | 297/316 |
| 4,640,546 | 2/1987 | Aquilar | 297/260 |

FOREIGN PATENT DOCUMENTS

| | | | |
|---|---|---|---|
| 2259383 | 6/1974 | Fed. Rep. of Germany | 297/310 |

*Primary Examiner*—James T. McCall

*Attorney, Agent, or Firm*—Fleit, Jacobson, Cohn, Price, Holman & Stern

[57] ABSTRACT

A lift recliner chair is provided also incorporating a rocker assembly including rocker structure mounted from the chair and floor engageable rocker plate structure rockably connected to the rocker structure, whereby the chair may be rocked back and forth relative to the rocker plate structure. However, inasmuch as the center of mass of a recliner chair and a person disposed thereon is appreciably rearwardly shifted relative to the chair base when the chair is in the recliner defining configuration, the chair is equipped with a downwardly extendable and upwardly retractable prop automatically shifted between the retracted and extended positions thereof as the chair is shifted between the chair defining and recliner defining configurations thereof. When the prop is in the downwardly extended position, it engages the floor from which the chair is supported rearward of the rocker assembly and in a manner to prevent rearward rocking of the chair relative to the rocker plate structure past the center position of rocking movement of the chair.

8 Claims, 2 Drawing Sheets

FIG. 1
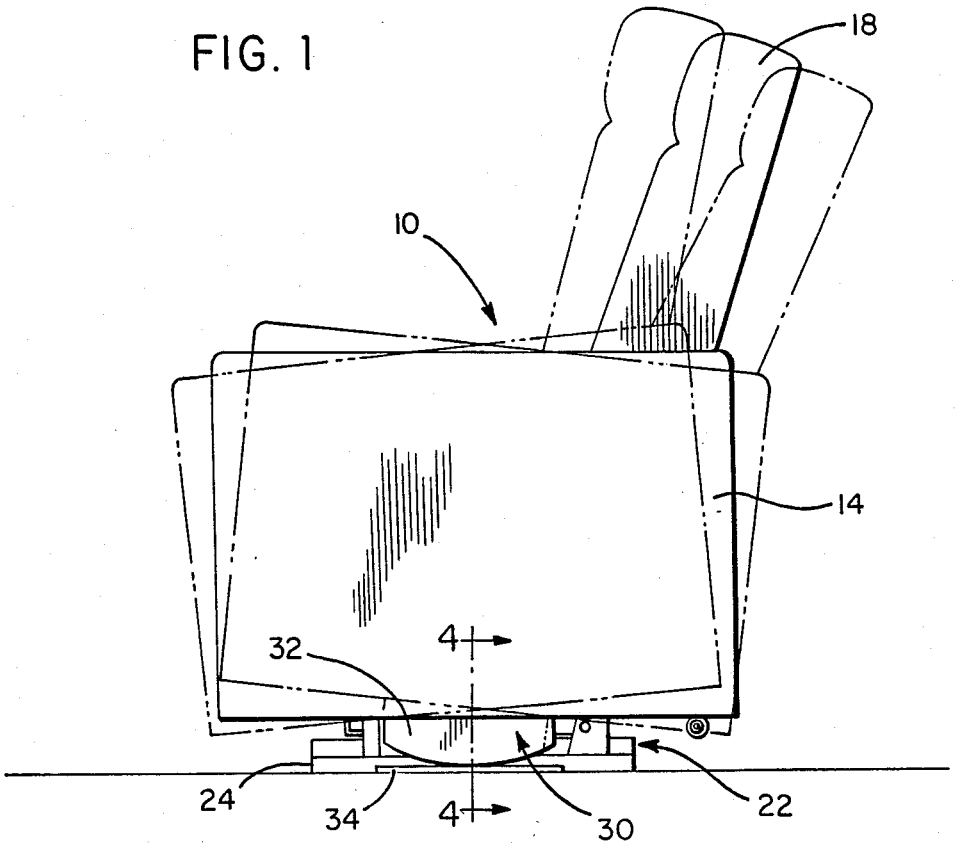
FIG. 2
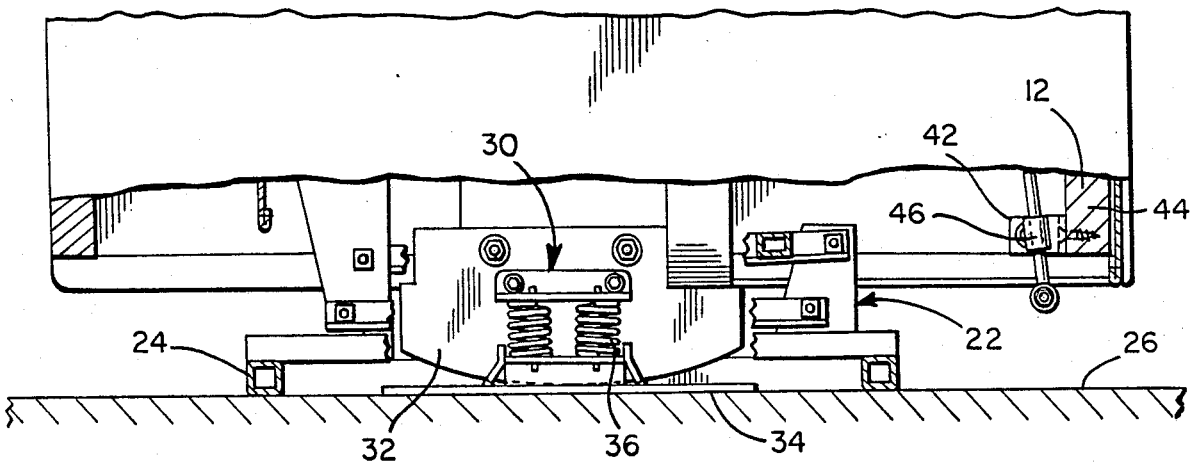
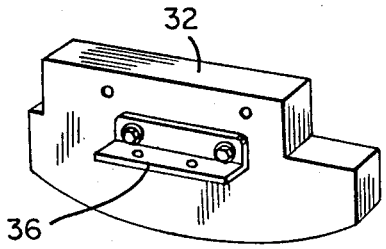
FIG. 5

LIFT RECLINER-ROCKER

BACKGROUND OF THE INVENTION

1. Field of the Invention

A rocker-recliner chair is provided incorporating therein a lift mechanism whereby the chair may be lifted and tilted forward relative to an associated floor to assist a person seated in the chair in assuming a standing position. Furthermore, the lift recliner-rocker includes prop structure which is downwardly extendable and upwardly rectractable relative to a rear portion of the chair frame and which is downwardly extended and upwardly retracted responsive to the back of the chair being shifted to its reclining and upright positions, respectively. The prop, when downwardly extended, engages the floor surface from which the chair is supported to prevent the chair from being rocked rearward from its center position of rocking movement and, in fact, the prop may be adjusted in a manner such that downward extension thereof for engagement with the floor actually effects a slight forward rocking displacement of the chair from its center position of rocking movement.

2. Description of Related Art

Various different forms of lift chairs, reclining lift chairs and rocker chairs heretofore have been provided such as those disclosed in U.S. Pat. Nos. 1,985,131, 2,772,723, 3,339,972, 3,596,991, 4,007,960, 4,038,599, 4,319,780, 4,453,766 and 4,640,546. However, these previously known devices do not combine the rocker ability of a lift rocker chair with a lift recliner chair. Further, inasmuch as the weight of a person disposed within a recliner chair is shifted rearwardly relative to the chair base when the recliner chair is in the recliner position thereof, it is imperative to include a rocker deactivating mechanism when a lift rocker mechanism is incorporated in a recliner chair.

SUMMARY OF THE INVENTION

The lift recliner-rocker chair of the instant invention incorporates, in a lift rocker chair, a recliner chair mechanism as well as downwardly extendable and upwardly retractable prop structure for engagement with the floor surface supporting the chair rearwardly of the latter when the lift mechanism is deactivated and the chair is transformed into its recliner position to thereby prevent the chair from rocking rearward from the center position of rocking movement thereof.

The main object of this invention is to provide a chair for the infirm and physically disabled and which may be used as a rocker, a recliner and which also incorporates therein a lift mechanism for lifting and forwardly tilting the chair when it becomes necessary for the occupant thereof to arise from the chair to a standing position.

Another object of this invention, in accordance with the preceding object is to provide a lift recliner-rocker chair incorporating a downwardly extendable and upwardly retractable prop mechanism for engagement with the floor rearward of the chair when the lift mechanism is upwardly retracted relative to the chair and the chair is transformed into its recliner mode with the prop being effective to prevent rearward rocking of the chair past the center position of rocking movement thereof.

A final object of this invention to be specifically enumerated herein is to provide a lift recliner-rocker chair in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a left side elevational view of the lift recliner-rocker chair of the instant invention with the chair back in the upstanding position and alternate rocking positions of the chair illustrated in phanton lines;

FIG. 2 is an enlarged fragmentary vertical sectional view of the lower portion of the chair shown in FIG. 1 illustrating portions of the lift an mechanisms of the chair as well as a portion of the prop mechanism of the chair;

FIG. 5 is a perspective view of one of the rockers of the chair.

DESCRIPTION OF THE PREFERRED EMBODIMENT

Figure 3:
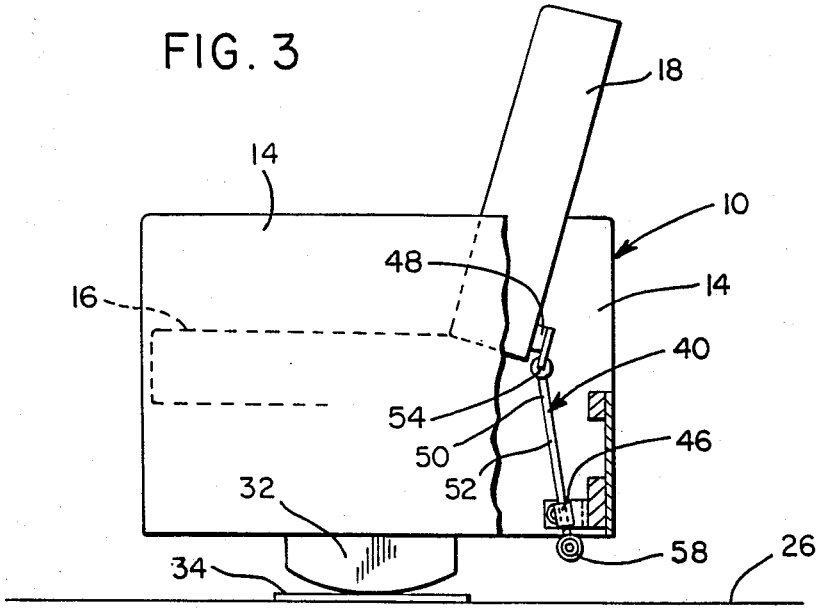
FIG. 3 is a side elevational schematic view of the chair with portions thereof broken away and illustrated in vertical section and the seat back of the chair disposed in an upright position and the prop mechanism upwardly retracted relative to the frame of the chair.

Referring now more specifically to the drawings, the numeral 10 generally designates the lift recliner-rocker chair of the instant invention. The chair 10 includes a frame 12 from which opposite side chair sides 14 are supported and a chair seat 16 and chair back 18 are supported from the chair frame 12 through the utilization of any suitable recliner mechanism such as that illustrated at 20 in FIG. 4. The recliner mechanism 20 is supported from the frame 12 and includes appropriate connections with the chair seat 16 and chair back 18, the chair back 18 being shiftable from the upright position thereof illustrated in FIG. 3 to the reclining position thereof illustrated in FIG. 3A and the chair seat being shiftable from the raised seat defining position thereof illustrated in phantom lines in FIG. 3 and the forwardly displaced and slightly lowered reclining position thereof illustrated in FIG. 3A. Further, it is to be noted that the recliner mechanism 20 may comprise any suitable reclining mechanism.

The chair 10 further includes a lift mechanism referred to in general by the reference numeral 22 which also may be conventional such as that disclosed in U.S. Pat. No. 4,083,559. The lift mechanism includes a lift base 24 shown in FIG. 2 in a partially upwardly retracted position. The lift base 24 is downwardly extended by the lift mechanism when actuated to lift the chair 10 and the chair frame 12, from which the lift mechanism 22 is supported, relative to the floor 26 upon which the frame 24 rests in FIG. 2. When the lift mechanism 22 is fully upwardly retracted relative to the frame 12, the frame 24 is elevated appreciably above the floor 26. The chair 10 additionally includes a rocker assembly generally referred to by the reference numeral 30 and including opposite side rocker panels or means 32 fixedly supported from the frame 12 and from which opposite side plate means in the form of rocker plates 34 are rockably supported, the plates 34 being engaged with the floor 26 and supported from the rocker panels 34 through the utilization of spring units 36 similar to those disclosed in U.S. Pat. No. 2,772,723.

When the lift recliner-rocker chair 10 is in the configuration thereof illustrated in FIG. 1 and the lift mechanism 22 has its lift base 24 elevated relative to the chair 10 to its uppermost limit position, the chair 10 may be rocked back and forth between the phantom line positions thereof illustrated in FIG. 1 with the weight of the chair being supported from the rocker plates 34 and the rocker panels 32 rocking back and forth relative to the plates 34.

Figure 3A:
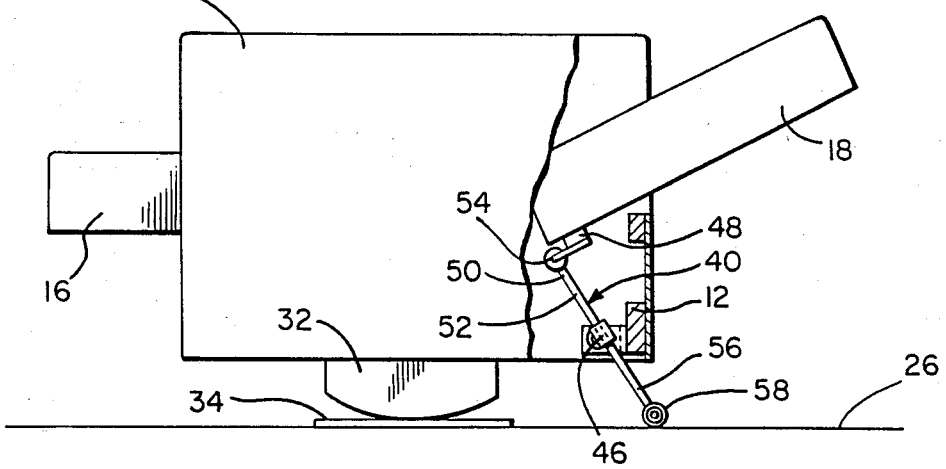
FIG. 3A is a side elevational schematic view similar to FIG. 3 but with the seat back in the recliner position thereof and the prop mechanism downwardly extended for engagement with the floor surface from which the chair is supported to prevent rearward rocking of the chair.
Figure 4:
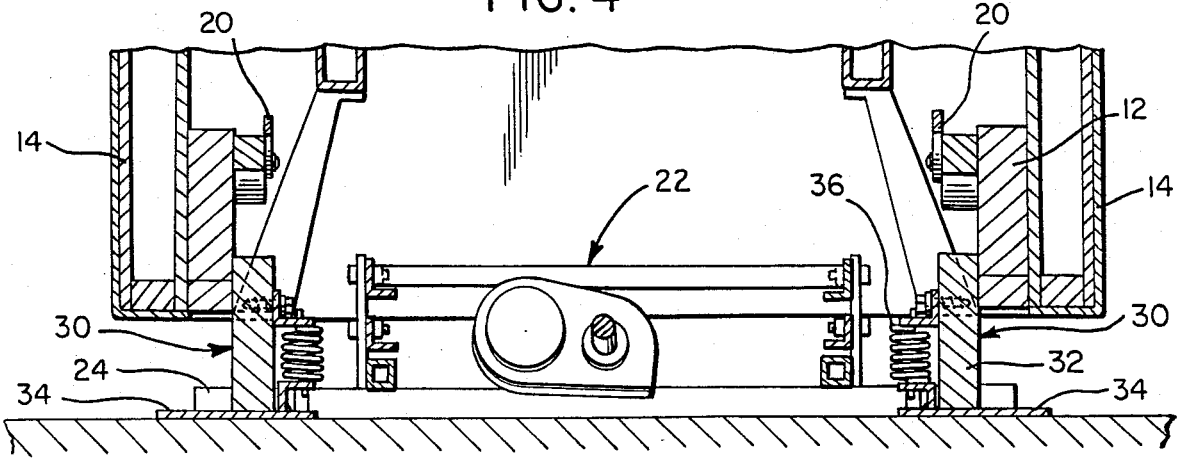
FIG. 4 is an enlarged fragmentary vertical sectional view taken substantially upon the plane indicated by section line 4—4 of FIG. 1 illustrating portions of the rocker mechanism and lift mechanism of the chair.

In addition, the chair 10 may have the chair seat 16 and chair back 18 shifted from the chair defining positions thereof illustrated in FIG. 3 to the recliner positions thereof illustrated in FIG. 3A.

However, a prop assembly referred to in general by the reference numeral 40 is provided and includes a first mounting bracket secured to the rear cross member 44 of the frame 12 in any convenient manner and from which a guide sleeve 46 is pivotally supported for angular displacement about a horizontal transverse axis. In addition, a second mounting bracket 48 is supported in any convenient manner from the rear lower marginal portion of the chair back 18 and pivotally supports the upper end 50 of an elongated prop rod 52 therefrom as at 54, the prop rod 52 being guidingly and slidingly received through the sleeve 46 and projecting downwardly therebelow. The lower end 56 of the prop rod 52 has a pair of opposite side resilient outer periphery equipped rollers 58 journalled therefrom.

From a comparison of FIGS. 3 and 3A, it may be seen that the prop rod 52 is upwardly retracted to an out-of-the-way position when the chair back 18 is in the upstanding position. However, when the chair back 18 is shifted toward the recliner position thereof illustrated in FIG. 3A, the prop rod 52 is projected downwardly and rearwardly from the rear marginal portion of the frame 12 and engages the floor 26 upon which the rocker plates 34 are supported. Thus, when the chair 10 is in the central position of rocking movement thereof illustrated in FIG. 3A and the chair back 18 is shifted to the recliner position, the chair 10 may not be rocked rearwardly of the center position of rocking movement thereof illustrated in FIGS. 3 and 3A. Also, if the effective length of the prop rod 52 is increased, when the chair back 18 is swung to the recliner position thereof illustrated in FIG. 3A, the frame 12 will be slightly forwardly rocked relative to the center position of movement thereof illustrated in FIGS. 3 and 3A.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In a lift chair having a lift base, guide means adjustably supporting said chair from said lift base and including force means connected between said lift base and chair to selectively raise and lower said chair with respect to said lift base, accessory base means supported from said chair and positioned to contact the floor before said lift base is fully raised relative to said chair so that full raising of said lift base relative to said chair elevates said lift base above the floor, said accessory base means including rocker assembly means incorporating rocker means mounted from said chair and floor engageable rocker plate disposed beneath and rockably connected to said rocker means for rockably supporting said rocker means and chair from said rocker plate means and thus the floor from which said rocker plate means is supported, whereby when said lift base is fully raised said chair will be supported from the floor by said accessory base means and be rockable relative to said floor, said chair comprising a recliner chair including a frame from which said rocker means of said rocker assembly means is supported, a seat portion supported from said frame, a back portion supported from said frame for swinging of said back portion between an upstanding position and a reclining position relative to said frame, and rear prop means shiftably supported from said frame and operatively connected to said back portion for downward extension and upward retraction of said prop means relative to said frame responsive to shifting of said back portion between said reclined and upstanding positions, respectively, said prop means, when extended downwardly relative to said frame, being engageable with said floor rearward of said rocker means to prevent rearward rocking of said frame when said back portion is in the reclined position thereof and when upwardly retracted being ineffective to engage said floor and thus ineffective to prevent rearward rocking of said frame when said back portion is in the upstanding position.

2. The lift chair of claim 1 wherein said rocker assembly means includes spring support means supporting said rocker plate means from said rocker means and yieldingly biasing said rocker means toward a center position of rocking movement of said rocker means relative to said rocker plate means.

3. The lift chair of claim 1 wherein said rocker means comprises rocker panels fixed relative to said frame.

4. The lift chair of claim 1 wherein the lower extremity of said prop means engageable with said floor includes resilient periphery equipped roller means.

5. The lift chair of claim 1 wherein said prop means includes an elongated upstanding prop rod having an upper end pivotally supported from said chair back and guide means pivotally supported from said frame relative to which said prop rod is longitudinally shiftably guided.

6. The lift chair of claim 5 wherein the lower extremity of said prop means engageable with said floor includes resilient periphery equipped roller means.

7. The lift chair of claim 6 wherein said rocker means comprises rocker panels fixed relative to said frame.

8. The lift chair of claim 7 wherein said rocker assembly means includes spring support means supporting said rocker plate means from said rocker means and yieldingly biasing said rocker means toward a center position of rocking movement of said rocker means relative to said rocker plate means.

* * * * *